US008069824B2

(12) United States Patent
Higgins

(10) Patent No.: US 8,069,824 B2
(45) Date of Patent: Dec. 6, 2011

(54) CIRCULATING FLUIDIZED BED BOILER AND METHOD OF OPERATION

(75) Inventor: Brian S. Higgins, Walnut Creek, CA (US)

(73) Assignee: Nalco Mobotec, Inc., Naperville, IL (US)

( * ) Notice: Subject to any disclaimer, the term of this patent is extended or adjusted under 35 U.S.C. 154(b) by 723 days.

(21) Appl. No.: 12/142,509

(22) Filed: Jun. 19, 2008

(65) Prior Publication Data

US 2009/0314226 A1 Dec. 24, 2009

(51) Int. Cl.
*F23C 10/04* (2006.01)

(52) U.S. Cl. ..... 122/4 D; 432/48; 165/104.16

(58) Field of Classification Search ..... 122/4 D; 432/48, 152; 48/197 R; 110/245; 165/104.16
See application file for complete search history.

(56) References Cited

U.S. PATENT DOCUMENTS

| | | | | |
|---|---|---|---|---|
| 3,105,540 | A | 10/1963 | Hardgrove | 431/9 |
| 3,528,797 | A | 9/1970 | Funk et al. | 71/39 |
| 3,565,757 | A | 2/1971 | Warshaw et al. | 23/2 |
| 3,773,897 | A | 11/1973 | Fields et al. | 423/235 |
| 3,847,564 | A | 11/1974 | Marion et al. | 48/95 |
| 3,860,384 | A | 1/1975 | Vulliet et al. | 41/4 |
| 3,900,554 | A | 8/1975 | Lyon | 423/235 |
| 3,970,739 | A | 7/1976 | Shiraishi et al. | 423/23 S |
| 4,021,188 | A | 5/1977 | Yamagishi et al. | 431/158 |
| 4,029,752 | A | 6/1977 | Cahn | 423/563 |
| 4,039,446 | A | 8/1977 | Ban et al. | 210/688 |
| 4,080,423 | A | 3/1978 | Smith et al. | 423/210 |
| 4,089,639 | A | 5/1978 | Reed et al. | 431/211 |
| 4,119,702 | A | 10/1978 | Anuhata et al. | 423/235 |
| 4,150,631 | A | 4/1979 | Frey et al. | 110/186 |
| 4,154,581 | A | 5/1979 | Nack et al. | 48/197 R |
| 4,173,454 | A | 11/1979 | Heins | 44/522 |
| 4,196,057 | A | 4/1980 | May et al. | 205/775.5 |
| 4,208,386 | A | 6/1980 | Arand et al. | 423/235 |
| 4,213,944 | A | 7/1980 | Azuhata et al. | 423/235 |
| 4,294,178 | A | 10/1981 | Borio et al. | 110/347 |
| 4,325,924 | A | 4/1982 | Arand et al. | 423/235 |
| 4,336,769 | A * | 6/1982 | Daman | 122/4 D |
| 4,344,371 | A * | 8/1982 | Zoschak | 110/229 |
| 4,375,949 | A | 3/1983 | Salooja | 431/7 |
| 4,381,718 | A | 5/1983 | Carver et al. | 110/347 |
| 4,430,094 | A * | 2/1984 | Gorzegno | 48/76 |
| 4,469,050 | A | 9/1984 | Korenberg | 122/4 D |

(Continued)

FOREIGN PATENT DOCUMENTS

DE 28 37 156 3/1979

(Continued)

OTHER PUBLICATIONS

Energy efficiency-our specialty-by Mobotec; undated related technology.

(Continued)

*Primary Examiner* — Gregory A Wilson
(74) *Attorney, Agent, or Firm* — MacCord Mason PLLC

(57) ABSTRACT

A circulating fluidized bed boiler having improved reactant utilization. The circulating fluidized bed boiler includes a circulating fluidized bed having a dense bed portion and a lower furnace portion above the dense bed portion. At least one secondary air and recirculated flue gas injection device is downstream of the circulating fluidized bed for providing mixing of the reactant and the flue gas in the furnace above the dense bed. The present invention also includes methods of operating a fluidized bed boiler.

75 Claims, 11 Drawing Sheets

U.S. PATENT DOCUMENTS

| | | | | | |
|---|---|---|---|---|---|
| 4,502,633 | A | | 3/1985 | Saxon | 239/422 |
| 4,504,211 | A | | 3/1985 | Beardmore | 44/604 |
| 4,506,608 | A | * | 3/1985 | Strohmeyer, Jr. | 110/245 |
| 4,507,075 | A | | 3/1985 | Buss et al. | 431/115 |
| 4,507,269 | A | | 3/1985 | Dean et al. | 423/235 |
| 4,565,137 | A | | 1/1986 | Wright | 110/264 |
| 4,584,948 | A | | 4/1986 | Syred et al. | 110/264 |
| 4,624,840 | A | | 11/1986 | Dean et al. | 423/235 |
| 4,627,965 | A | | 12/1986 | Hegemann et al. | 423/242 |
| 4,672,900 | A | | 6/1987 | Santalla et al. | 431/9 |
| 4,704,084 | A | | 11/1987 | Liu et al. | 431/7 |
| 4,751,065 | A | | 6/1988 | Bowers | 423/235 |
| 4,766,851 | A | | 8/1988 | Emsperger et al. | 122/4 |
| 4,777,024 | A | | 10/1988 | Epperly et al. | 423/235 |
| 4,780,289 | A | | 10/1988 | Epperly et al. | 423/235 |
| 4,788,919 | A | * | 12/1988 | Holm et al. | 110/347 |
| 4,824,441 | A | | 4/1989 | Kindig | 44/604 |
| 4,842,834 | A | | 6/1989 | Burton | 423/235 |
| 4,873,930 | A | | 10/1989 | Egnese et al. | 110/345 |
| 4,896,631 | A | * | 1/1990 | Holm et al. | 122/4 D |
| 4,915,036 | A | | 4/1990 | DeVita | 110/215 |
| 4,927,612 | A | | 5/1990 | Bowers | 423/235 |
| 4,962,711 | A | | 10/1990 | Yamauchi et al. | 110/347 |
| 4,978,514 | A | | 12/1990 | Hofmann et al. | 423/235 |
| 4,985,218 | A | | 1/1991 | DeVita | 423/235 |
| 4,992,249 | A | | 2/1991 | Bowers | 423/235 |
| 5,017,347 | A | | 5/1991 | Epperly et al. | 423/235 |
| 5,032,154 | A | | 7/1991 | Wright | 422/109 |
| 5,048,432 | A | * | 9/1991 | Hofmann et al. | 110/345 |
| 5,052,921 | A | | 10/1991 | Hemsath | 423/121 |
| 5,057,293 | A | | 10/1991 | Epperly et al. | 423/235 |
| 5,105,747 | A | | 4/1992 | Khinkis et al. | 110/345 |
| 5,139,754 | A | | 8/1992 | Luftglass et al. | 423/235 |
| 5,146,858 | A | | 9/1992 | Tokuda et al. | 110/261 |
| 5,240,404 | A | | 8/1993 | Hemsath et al. | 431/9 |
| 5,261,602 | A | | 11/1993 | Brent et al. | 239/132.3 |
| 5,286,467 | A | | 2/1994 | Sun et al. | 423/239.1 |
| 5,310,334 | A | | 5/1994 | Spiros | 431/5 |
| 5,336,081 | A | | 8/1994 | Saito et al. | 431/190 |
| 5,342,592 | A | | 8/1994 | Hoblyn et al. | 423/235 |
| 5,345,883 | A | | 9/1994 | Panos | 110/345 |
| 5,363,812 | A | * | 11/1994 | Belin et al. | 122/4 D |
| 5,453,258 | A | | 9/1995 | Lippmann et al. | 423/235 |
| 5,489,419 | A | | 2/1996 | Diep et al. | 423/235 |
| 5,536,482 | A | | 7/1996 | Diep et al. | 423/235 |
| 5,585,081 | A | | 12/1996 | Chu et al. | 423/239.1 |
| 5,587,283 | A | | 12/1996 | Karinthi et al. | 431/10 |
| 5,690,039 | A | | 11/1997 | Monroe et al. | 110/264 |
| 5,707,596 | A | | 1/1998 | Lewandowski et al. | 423/235 |
| 5,728,357 | A | | 3/1998 | von Harpe | 423/239.1 |
| 5,784,975 | A | * | 7/1998 | Tanca | 110/245 |
| 5,809,910 | A | | 9/1998 | Svendssen | 110/235 |
| 5,853,684 | A | | 12/1998 | Fang et al. | 423/239.1 |
| 5,854,173 | A | | 12/1998 | Chang et al. | 502/417 |
| 6,019,068 | A | | 2/2000 | Tsuo et al. | 122/4 D |
| 6,042,371 | A | | 3/2000 | Mitani et al. | 431/215 |
| 6,048,510 | A | | 4/2000 | Zauderer | 423/235 |
| 6,109,911 | A | | 8/2000 | Tamminen et al. | 431/4 |
| 6,190,628 | B1 | | 2/2001 | Carter | 422/168 |
| 6,213,032 | B1 | | 4/2001 | Breen et al. | 110/345 |
| 6,230,664 | B1 | | 5/2001 | Janka et al. | 122/4 D |
| 6,280,695 | B1 | | 8/2001 | Lissiamski et al. | 423/239.1 |
| 6,357,367 | B1 | | 3/2002 | Breen et al. | 110/345 |
| 6,398,039 | B1 | | 6/2002 | Xue et al. | 210/504 |
| 6,485,289 | B1 | | 11/2002 | Kelly et al. | 431/4 |
| 6,527,828 | B2 | | 3/2003 | Flippo et al. | 95/54 |
| 6,532,905 | B2 | | 3/2003 | Belin et al. | 122/4 D |
| 6,818,043 | B1 | | 11/2004 | Change et al. | 95/37 |
| 6,953,494 | B2 | | 10/2005 | Nelson, Jr. | 95/134 |
| 7,198,769 | B2 | | 4/2007 | Cichanowicz | 423/239.1 |
| 7,335,014 | B2 | | 2/2008 | Higgins | 431/4 |
| 7,410,356 | B2 | * | 8/2008 | Higgins et al. | 432/17 |
| 7,562,641 | B2 | * | 7/2009 | Murakami et al. | 122/4 D |
| 2003/0110948 | A1 | | 6/2003 | Gaita et al. | 96/108 |
| 2003/0145580 | A1 | | 8/2003 | Ripper et al. | 60/286 |
| 2004/0045437 | A1 | | 3/2004 | Chang et al. | 95/134 |
| 2004/0120872 | A1 | | 6/2004 | Fan et al. | 423/239.1 |
| 2004/0185399 | A1 | | 9/2004 | Moberg | 431/4 |
| 2004/0185401 | A1 | | 9/2004 | Moberg | 431/9 |
| 2004/0185402 | A1 | | 9/2004 | Moberg | 431/9 |
| 2004/0253161 | A1 | | 12/2004 | Higgins | 423/235 |
| 2005/0000901 | A1 | | 1/2005 | Campbell et al. | 210/660 |
| 2005/0002841 | A1 | | 1/2005 | Moberg | 423/235 |
| 2005/0013755 | A1 | | 1/2005 | Higgins | 423/235 |
| 2007/0119387 | A1 | * | 5/2007 | Higgins | 122/4 D |
| 2008/0153048 | A1 | * | 6/2008 | Murakami et al. | 432/17 |

FOREIGN PATENT DOCUMENTS

| | | |
|---|---|---|
| EP | 0 326 943 | 1/1989 |
| EP | 0 787 682 | 8/1997 |
| EP | 0 287 224 | 10/1998 |
| EP | 0936405 | 8/1999 |
| GB | GN 2 001 419 | 7/1978 |
| JP | 53-112273 | 9/1978 |
| JP | 2003 31322 | 1/2003 |
| WO | WO/87/03507 | 6/1987 |
| WO | WO/2005/079305 | 8/1999 |

OTHER PUBLICATIONS

Combined DeNox/DeSox and additional NOx Reduction by Cleaning Flue Gas Condensate from Ammonia, Moberg, et al, presentation at PowerGen Intl. Nov. 30-Dec. 2, 1999.

RJM-LT, "Does This New NOx Control Technology Obsolete SCRs?"; RMJ Corp., undated related technology.

* cited by examiner (Related Technology)

(Related Technology)

CIRCULATING FLUIDIZED BED BOILER AND METHOD OF OPERATION

BACKGROUND (1) Field of the Invention

The present inventions relate generally to circulating fluidized bed boilers, and more particularly to circulating fluidized bed boilers having improved reactant utilization and/or reduction of undesirable combustion products.

(2) Description of the Related Technology

The combustion of sulfur-containing carbonaceous compounds, especially coal, results in a combustion product gas containing unacceptably high levels of sulfur dioxide. Sulfur dioxide is a colorless gas, which is moderately soluble in water and aqueous liquids. It is formed primarily during the combustion of sulfur-containing fuel or waste. Once released to the atmosphere, sulfur dioxide reacts slowly to form sulfuric acid ($H_2SO_4$), inorganic sulfate compounds, and organic sulfate compounds. Atmospheric $SO_2$ or $H_2SO_4$ results in undesirable "acid rain."

According to the U.S. Environmental Protection Agency, acid rain causes acidification of lakes and streams and contributes to damage of trees at high elevations and many sensitive forest soils. In addition, acid rain accelerates the decay of building materials and paints, including irreplaceable buildings, statues, and sculptures. Prior to falling to the earth, $SO_2$ and NOx gases and their particulate matter derivatives, sulfates and nitrates, also contribute to visibility degradation and harm public health.

Air pollution control systems for sulfur dioxide removal generally rely on neutralization of the absorbed sulfur dioxide to an inorganic salt by alkali to prevent the sulfur from being emitted into the environment. The alkali for the reaction most frequently used include either calcitic or dolomitic limestone, slurry or dry quick and hydrated lime, and commercial and byproducts from Theodoric lime and trona magnesium hydroxide. The $SO_2$, once absorbed by limestone, is captured in the existing particle capture equipment such as an electrostatic precipitator or baghouse.

Circulating fluidized bed boilers (CFB) utilize a fluidized bed of coal ash and limestone or similar alkali to reduce $SO_2$ emissions. The bed may include other added particulate such as sand or refractory. Circulating fluidized bed boilers are generally effective at reducing $SO_2$ and NOx emissions. A 92% reduction in $SO_2$ emissions is typical, but can be as high as 98%. In most instances, the molar ratio of Ca/S needed to achieve this reduction is designed to be approximately 2.2, which is 2.2 times the stoichiometric ratio of the reaction of calcium with sulfur. However, due to inefficient mixing, the Ca/S molar ratio often increases to 3.0 or more to achieve desired levels of $SO_2$ capture. The higher ratio of Ca/S requires more limestone to be utilized in the process, thereby increasing operating costs. Additionally, inefficient mixing results in the formation of combustion "hotspots" that promote the formation of NOx.

FIG. 1 shows one embodiment of a conventional circulating fluidized bed boiler 1. Circulating fluidized bed boiler 1 typically includes furnace 2, cyclone dust collector 3, and seal box 4. Often times, these units include external heat exchanger 6.

Air distribution nozzles 7 introduce fluidizing air A to furnace 2 to create a fluidizing condition in furnace 2. Nozzles 7 are typically arranged in a bottom part of the furnace 2. Flue gas generated by combustion in furnace 2 flows into cyclone dust collector 3.

Cyclone dust collector 3 separates particles from the flue gas. Particles caught by cyclone dust collector 3 flow into seal box 4. External heat exchanger 6 performs heat exchange between the circulating particles and in-bed tubes in heat exchanger 6. Air box 10 is arranged in a bottom of seal box 4 so as to intake upward fluidizing air B through air distribution plate 9. The particles in seal box 4 are introduced to external heat exchanger 6 and are in-bed tube 5 under fluidizing condition.

Cyclone dust collector 3 is also connected with heat recovery area 8 and some flue gas generated by combustion in furnace 2 also flows into heat recovery area 8. Heat recovery area 8 typically includes a super heater and economizer. As depicted, furnace 2 also includes a water cooled furnace wall 2*a*.

In a conventional CFB boiler, there may be good mixing or kinetic energy in the lower furnace (e.g., in the dense bed). Applicant has discovered, however, that there may be insufficient mixing in the upper furnace (e.g., above the dense bed) to more fully utilize the reactants added to reduce the emissions in the flue gases. As used herein, the dense bed is generally where the gas and particle density is greater than about twice the boiler exit gas/particle density.

In the lower furnace, which is typically just in front of the coal feed port, volatile matter (gas phase) from the coal quickly mixes and reacts with available oxygen. This creates a low density, hot gaseous plume that is very buoyant relative to the surrounding particle laden flow. This buoyant plume quickly rises, forming a channel, chimney or plume from the lower furnace to the roof. Limestone, which absorbs and reduces the $SO_2$, is absent in the channel. After hitting the roof of the furnace, it has been discovered that this high $SO_2$ flue gas may exit the furnace and escape the cyclone without sufficient $SO_2$ reaction. Measurements of the furnace exit duct have shown nearly 10 times higher $SO_2$ concentrations in the upper portion of the exit duct relative to the bottom of the duct.

In the furnace of a conventional circulating fluidized bed boiler, bed materials 11 which comprise ash, sand, and/or limestone etc. are under suspension by the fluidizing condition. Most of the particles entrained with flue gas escape the furnace 2 and are caught by the cyclone dust collector 3 and are introduced to the seal box 4. The particles thus introduced to the seal box 4 are aerated by the fluidizing air B and are heat exchanged with the in-bed tubes 5 of the optional external heat exchanger 6 so as to be cooled. The particles are returned to the bottom of the furnace 2 through a duct 12 so as to re-circulate through the furnace 2.

Applicant previously discovered that high velocity mixing air injection may be used above the dense bed to both reduce limestone usage and reduce the NOx emissions in a circulating fluidized bed boiler, see, for example, the teachings contained in commonly owned U.S. Patent Application Serial No. 11/281,915 filed Nov. 17, 2005, now U.S. Pat. No. 7, 410,356, issued Aug. 12 2008. In the current application, this technology is generally referred to as Over Dense Bed Air (ODBA) technology. FIG. 2 shows an example of ODBA technology. In system 100, which is similar to the circulating fluidized bed boiler described above, furnace 2 is fitted with secondary air injection ports or devices 20 injecting the ODBA into the fluidized bed above the dense bed. Applicant typically places these injection devices in a spaced-apart manner to create rotational flow of the fluidized bed zone. For example, the secondary air injection devices are spaced asymmetrically to generate rotation in the boiler. Since many boilers are wider than they are deep, in an embodiment, a user may set up two sets of nozzles to promote counter rotating. As set forth in the previous application, Applicant found that such systems provide vigorous mixing of the fluidized bed space, resulting in greater reaction efficiency between the $SO_2$ and limestone and thereby permitting the use of less limestone to achieve a given $SO_2$ reduction level. Applicant also believes the enhanced mixing permits the reduction of the stoichiometric ratio of Ca/S to achieve the same level of $SO_2$ reduction. The utility and efficacy of this technology was explained in part, based on a computational fluid dynamics analytic software program, FLUENT, available from Fluent, Inc. of Lebanon, NH.

FLUENT, a computational fluid dynamics analytic software program available from Fluent, Inc. of Lebanon, N.H., was used to model two-phase thermo-fluid phenomena in a CFB power plant. FLUENT solves for the velocity, temperature, and species concentrations fields for gas and particles in the furnace. Since the volume fraction of particle phase in a CFB is typically between about 0.1% and 0.3%, a granular model solving multi-phase flow was applied to this case. In contrast to conventional pulverized-fuel combustion models, where the particle phase is solved by a discrete phase model in a granular model both gas phase and particle phase conservation equations are solved in an Eulerian reference frame.

The solved conservation equations included continuity, momentum, turbulence, and enthalpy for each phase. In this multi-phase model, the gas phase (>99.7% of the volume) is the primary phase, while the particle phases with its individual size and/or particle type are modeled as secondary phases. A volume fraction conservation equation was solved between the primary and secondary phases. A granular temperature equation accounting for kinetic energy of particle phase was solved, taking into account the kinetic energy loss due to strong particle interactions in a CFB. This model took five days to converge to a steady solution, running on six CPUs in parallel.

While ash and limestone were treated in the particle phase, coal combustion was modeled in the gas phase. Coal was modeled as a gaseous volatile matter with an equivalent stoichiometric ratio and heat of combustion. The following two chemical reactions are considered in the CFB combustion system:

$$CH_{0.85}O_{0.14}N_{0.07}S_{0.02}+1.06O_2 \rightarrow 0.2CO+0.8CO_2+0.43H_2O+0.035N_2+0.02SO_2$$

$$CO+0.5O_2 \rightarrow CO_2$$

The chemical-kinetic combustion model included several gas species, including the major products of combustion: CO, $CO_2$, and $H_2O$. The species conservation equations for each gas species were solved. These conservation laws have been described and formulated extensively in computational fluid dynamics (CFD) textbooks. A k-$\epsilon$ turbulence model was implemented in the simulation, and incompressible flow was assumed for both baseline and invention cases.

All differential equations were solved in unsteady-state because of the unsteady-state hydrodynamic characteristics in the CFB boiler. Each equation was solved to the convergence criterion before the next time step is begun. After the solution was run through several hundred-time steps, and the solution was behaving in a "quasi" steady state manner, the time step was increased to speed up convergence. Usually the model was solved for more than thirty seconds of real time to achieve realistic results.

The CFD computational domain used for modeling is 100 feet high, 22 feet deep, and 44 feet wide. The furnace has primary air inlet through grid and 14 primary ports on all four walls. It also has 18 secondary injection ports, 8 of them with limestone injection, and 4 start-up burners on both front and back walls. Two coal feeders on the front wall convey the waste coal into the furnace. The other two coal feeders connect to each of the cyclone ducts after the loop seal. Two cyclones connecting to the furnace through two ducts at the top of the furnace collect the solid materials, mainly coal ash and limestone, and recycle back into the furnace at the bottom. The flue gas containing major combustion products and fly ash and fine reacted (and/or unreacted) limestone particles leaves the top of the cyclone and continue in the backpass. Water walls run from the top to the bottom of all four-side walls of the furnace. There were three stages of superheaters. The superheater I and II are in the furnace, whereas the superheater III is in the backpass.

The cyclone was not included in the CFB computational domain because the hydrodynamics of particle phase in the cyclone is too complex to practically include in the computation. The superheat pendants are included in the model to account for heat absorption and flow stratification, and are accurately depicted by the actual number of pendants in the furnace with the actual distance. Note that the furnace geometry was symmetric in width, so the computational domain only represents one half of the furnace. Consequently, the number of computational grid is only half, which reduced computational time.

Table 1 shows the baseline system operating conditions including key inputs for the model furnace CFD baseline simulations. In the baseline system, some secondary air is injected into the dense bed.

TABLE 1

| Parameter | Unit | Value |
|---|---|---|
| System load | $MW_{gross}$ | 122 |
| Net load | $MW_{net}$ | 109 |
| System firing rate | MMBtu/hr | 1226 |
| System excess $O_2$ | %-wet | 2.6 |
| System excess Air | % | 14.9 |
| System coal flow | kpph | 187 |
| Total air flow (TAF) | kpph | 1114 |
| Primary air flow rate through bed grid | kpph | 476 |
| Primary air flow rate through 14 ports | kpph | 182 |
| Primary air temperature | ° F. | 434 |
| Secondary air flow rate through 18 injection ports | kpph | 262 |
| Secondary air through 4 start-up burners | kpph | 104 |
| Secondary air through 4 coal feeders | kpph | 65 |
| Air flow rate through limestone injection | kpph | 11.5 |
| Air flow through loop seal | kpph | 12.8 |
| Secondary air temperature | ° F. | 401 |
| Limestone injection rate | kpph | 40 |
| Solid recirculation rate | kpph | 8800 |

Table 2 shows the coal composition of the baseline case.

TABLE 2

| Sample Time | | |
|---|---|---|
| Proximate analysis | | |
| Volatiles Matter | [wt % ar] | 15.09 |
| Fixed Carbon | [wt % ar] | 35.06 |
| Ash | [wt % ar] | 42.50 |
| Moisture | [wt % ar] | 7.07 |
| HHV (Btu/lb) | [Btu/lb] | 6800.0 |
| Ultimate analysis | | |
| C | [wt % ar] | 41.0 |
| H | [wt % ar] | 2.1 |
| O | [wt % ar] | 1.2 |
| N | [wt % ar] | 3.5 |
| S | [wt % ar] | 2.63 |

TABLE 2-continued

| Sample Time | | |
|---|---|---|
| Ash | [wt % ar] | 42.5 |
| $H_2O$ | [wt % ar] | 7.07 |

In FLUENT, the coal is modeled as a gaseous fuel stream and a solid particle ash stream with the flow rates calculated from the total coal flow rate and coal analysis. The gaseous fuel is modeled as $CH_{0.85}O_{0.14}N_{0.07}S_{0.02}$ and is given a heat of combustion of $-3.47\times10^7$ J/kmol. This is equivalent to the elemental composition and the heating value of the coal in the tables.

The high velocity injection was found to improve the mixing by relatively uniformly distributing air into the furnace. The mixing of the furnace was quantified by a coefficient of variance (CoV), which is defined as standard deviation of $O_2$ mole fraction averaged over a cross section divided by the mean $O_2$ mole fraction. The Coefficient of Variance ($\sigma/\bar{x}$) in $O_2$ distribution for the baseline case and the previous invention case over four horizontal planes are compared in Table 3. As can be seen, CoV is lower relative to the baseline, indicating improved mixing.

TABLE 3

| Furnace Height [ft] | Baseline case | ODBA |
|---|---|---|
| 33 | 66% | 43% |
| 49 | 84% | 40% |
| 66 | 100% | 47% |
| 80 | 80% | 46% |

Somewhat similarly, FIG. 3 shows the mass weighted CO relative to the baseline case. As seen in the low bed below the high velocity air injection ports, the CO concentration is higher relative to the baseline case. Above the high velocity air injection ports, the CO concentration rapidly decreases, and the furnace exit CO is even lower than that in the baseline case. The rapid reduction in CO relative to the base line indicates better and more complete mixing.

FIG. 4 shows the particle fraction distributions relative to the baseline case. The solid volume fraction in the upper furnace is between 0.001 to 0.003. As seen, the lower bed is more dense than the dilute upper bed. The distribution also reveals particle clusters in the bed, which is one of the typical features of particle movement in CFBs. The air and flue gas mixtures move upward through these clusters. Similar particle flow characteristics can be seen relative to the baseline case, however, it is also observed that the lower bed below the high velocity air injection is slightly denser than the baseline case, due to low total air flow in the lower bed. The upper bed shows similar particle volume fraction distribution relative to the baseline case.

FIG. 5 shows turbulent mixing of air jets and bed particles relative to the baseline case. As seen, in the baseline case, a maximum turbulent kinetic energy appears in the dense bed in the lower furnace and rapidly diminishes as jets penetrate into and mix in the furnace. With ODBA technology, the peak kinetic energy is located well above the dense bed, which allows for significant penetration and mixing. Applicant believes that turbulence is dissipated into the bulk flow through eddy dissipation, e.g., a large amount of kinetic energy results in better mixing between the high velocity air and the flue gas.

The calculated results for the reduction of $SO_2$ and other chemical species by limestone reaction were better than would be expected. The enhanced mixing achieved using this technology is predicted to reduce the stoichiometric ratio of Ca/S in the CFB from ~3.0 to ~2.4, while achieving the same level of $SO_2$ reduction (92%). The reduction in Ca/S corresponds to reduced limestone required to operate the boiler and meet $SO_2$ regulations. Since limestone for CFB units often costs more than the fuel (coal or gob), this is a significant reduction on the operational budget for a CFB plant.

Despite these benefits, Applicant discovered ways to improve upon the ODBA technology while maintaining the above-discussed benefits. For example, Applicant discovered that after a certain amount of secondary air is injected over the dense bed as a percentage of total air flow (TAF), limestone savings and SOx reduction began to diminish. It is to these, and other, problems that the present invention is directed.

SUMMARY

By way of summary, the present inventions are directed to, inter alia, systems and methods for improving reactant utilization. Embodiments of the present invention are also directed to improving SOx reduction. Embodiments of the present invention are also directed to improving combustion. Embodiments of the present invention are also directed to improving reactant utilization, improving SOx reduction, and improving combustion.

In one embodiment, the invention includes a circulating fluidized bed boiler. The boiler includes a circulating fluidized bed including a dense bed portion and a lower furnace portion above the dense bed portion. The boiler also includes a reactant, which is typically located in the furnace. The reactant is used to reduce the emission of at least one combustion product in the flue gas. A plurality of injection devices configured to inject recirculated flue gas and/or secondary air are positioned downstream of the dense bed for providing mixing of the reactant and the flue gas in the furnace above the dense bed. Using this configuration, the amount of reactant required for the reduction of the emission of the combustion product can be reduced.

In most embodiments, the dense bed portion of the circulating fluidized bed boiler is a fuel rich stage, for example, maintained below the stoichiometric ratio, and the lower furnace portion is a fuel lean stage, for example, maintained above the stoichiometric ratio.

The reactant may vary from embodiment to embodiment. For example, various reactants include caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ({Ni, Mg, Fe}$CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), or any variation of mixtures thereof. In many embodiments, the reactant is limestone.

The secondary air and recirculated flue gas injection devices may also vary from embodiment to embodiment. Various embodiments may include a plurality of devices, e.g, 2-60, however, some embodiments of the invention may include a single device. Embodiments may include about 10-15, about 15-45, about 20-40, etc. In most embodiments, at least one of the devices will have a jet penetration, when unopposed, of greater than about 50% of the furnace width. Still, other embodiments may include, at least two, at least three, at least four, at least five, at least six, at least seven, at least eight, at least nine, at least ten, at least eleven, at least twelve, at least thirteen, at least fourteen, at least fifteen, etc., up to all of the devices with a similar jet penetration configuration. Somewhat similarly, in various embodiments, the at least one of the devices may have a jet stagnation pressure greater than about 15 inches of water above the furnace pressure. The jet stagnation pressure may range from about will be about 15 inches to about 70 inches of water above the furnace pressure, or higher. For example, often times, jet stagnation pressure may be about 30, about 35, about 40, about 45, about 50, about 55, about 60, about 65 or about 70 inches of water above the furnace pressure. The positioning of secondary air and recirculated flue gas injection devices within the furnace can vary, but, most typically, they are located in the lower furnace portion of the circulating fluidized bed boiler above the dense bed. In one embodiment, the secondary air and recirculated flue gas injection devices deliver about 10% to about 80% of the total air flow to the boiler. As used herein, total air flow (TAF) is also intended to be inclusive of gas flow where appropriate.

In another embodiment, the plurality of secondary air and recirculated flue gas injection devices are in fluid communication with at least one secondary air source and at least one recirculated flue gas source. These sources may be chosen from, for example, a flue gas duct upstream of an air heater, a flue gas duct downstream of an air heater, a secondary air source upstream of an air heater, and a secondary air source downstream of an air heater. Such a configuration will allow for, inter alia, the delivery of at least a cold or hot recirculated flue gas, and at least a cold or hot secondary air source above the dense bed. Using such configurations, temperature regulation of air and gas to the injection devices can be achieved.

In other embodiments, the invention may include a return system for returning carry over particles from the flue gas to the circulating fluidized bed. Typically, the return system will include a separator, e.g., a cyclone separator, for removing carry over particles from the flue gas.

Other embodiments of the invention include methods of operating furnaces having circulating fluidized beds. In one embodiment, the method comprises combusting fuel in a fluidized bed having a dense bed portion and a lower furnace portion adjacent to the dense bed portion. The method also includes injecting a reactant into the furnace to reduce the emission of at least one combustion product in the flue gas. The method also includes injecting recirculated flue gas and/or secondary air and into the furnace above the dense bed.

Beneficial results achievable according to systems and methods of the present invention include, inter alia, a reduction in the amount of reactant needed to reduce the emission of the at least one combustion product.

In typical embodiments, the secondary air is injected at a height in the furnace where column density is less than about 165% of the furnace exit column density. Somewhat similarly, in many embodiments the recirculated flue gas will be injected at a height in the furnace where column density is less than about 165% of the furnace exit column density. In some embodiments, the secondary air is injected at a position between about 10 feet and 30 feet above the dense bed portion. In some embodiments, the recirculated flue gas is injected at a position between about 10 feet and 30 feet above the dense bed portion.

In many embodiments, the secondary air and the recirculated flue gas provide about 10% to about 80% of the total air flow to the boiler. The amount of secondary air and recirculated flue gas can be changed from embodiment to embodiment. By way of example, secondary air may be injected in an amount, as a percentage of total air flow, including about 1% to about 40%, about 5% to about 40%, about 10% to about 40%, about 15% to about 40%, about 20% to about 40%, about 25% to about 40%, about 30% to about 40%, and about 35% to about 40%; and, recirculated flue gas may be injected in an amount, as a percentage of total air flow, including about 1% to about 40%, about 5% to about 40%, about 10% to about 40%, about 15% to about 40%, about 20% to about 40%, about 25% to about 40%, about 30% to about 40%, and about 35% to about 40%.

Embodiments of the invention also include injecting hot and/or cold secondary air and hot and/or cold recirculated flue gas.

The above summary was intended to summarize certain embodiments of the present invention. Apparatuses and methods of the present inventions will be set forth in more detail, along with examples demonstrating efficacy, in the figures and detailed description below. It will be apparent, however, that the detailed description is not intended to limit the present invention, the scope of which should be properly determined by the appended claims.

DETAILED DESCRIPTION OF ILLUSTRATIVE EMBODIMENTS

In the present inventions, "reducible acid" refers to acids in which the acidity can be reduced or eliminated by the electrochemical reduction of the acid. The term "port" is used to describe a reagent injection passageway without any constriction on the end. The term "injector" is used to describe a reagent injection passageway with a constrictive orifice on the end. The orifice can be a hole or a nozzle. An "injection device" or "injection port" is a device that includes any of ducts, ports, injectors, or a combination thereof. Most typically, injection ports or devices include at least an injector. "ODB" is an acronym for "over dense bed".

Figure 1:
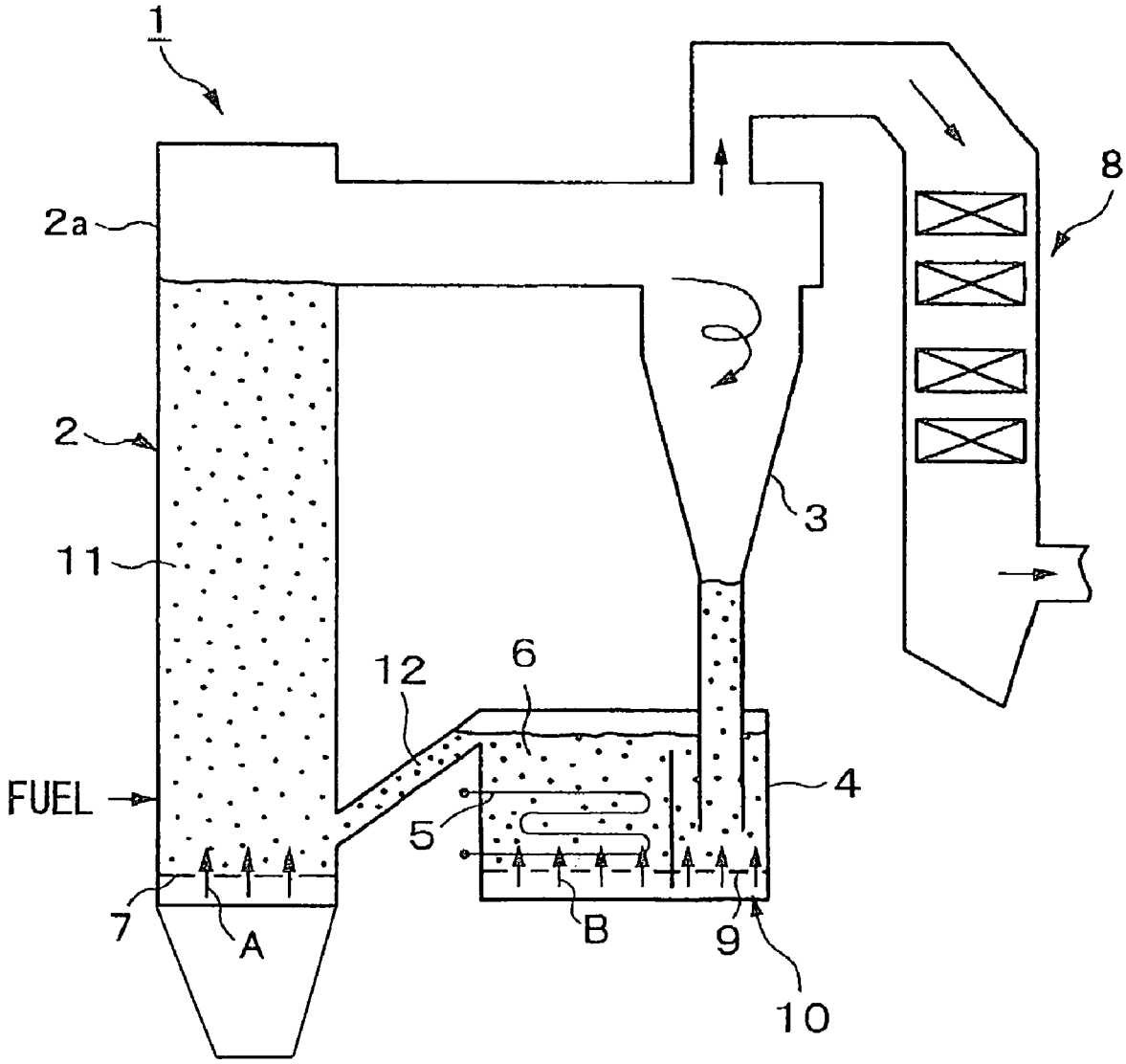
FIG. 1 is an illustration of a conventional circulating fluidized bed boiler (CFB)
Figure 2:
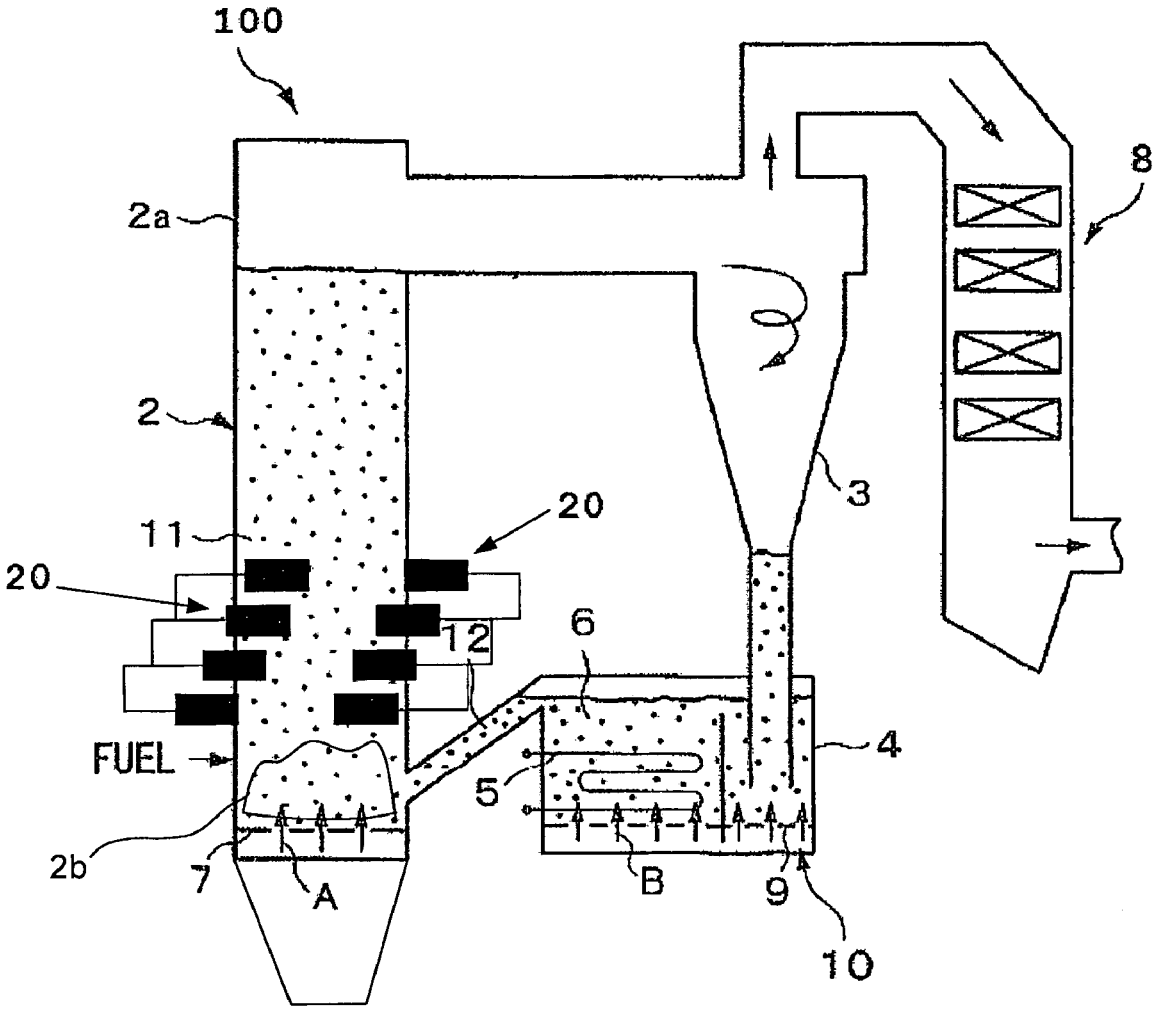
FIG. 2 is an illustration of a circulating fluidized bed boiler according to inventions made by Applicant.
Figure 3:
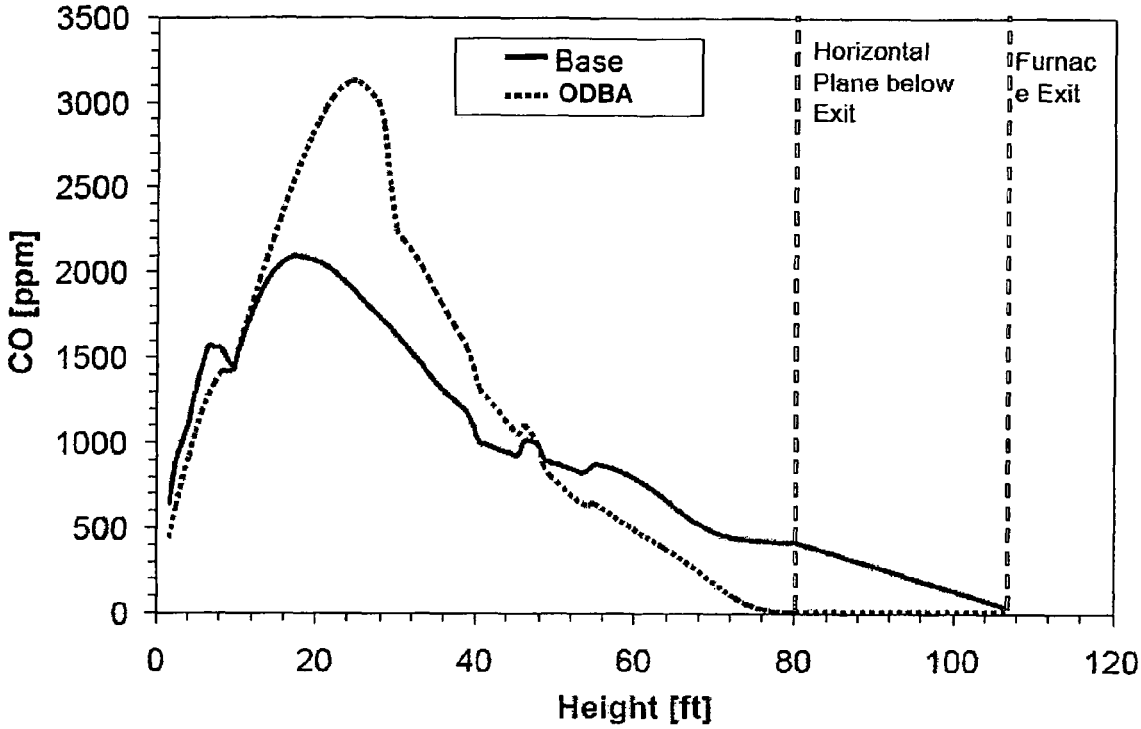
FIG. 3 is a graphical representation of the effect of Applicant's inventions on mass weighted CO relative to height.
Figure 4:
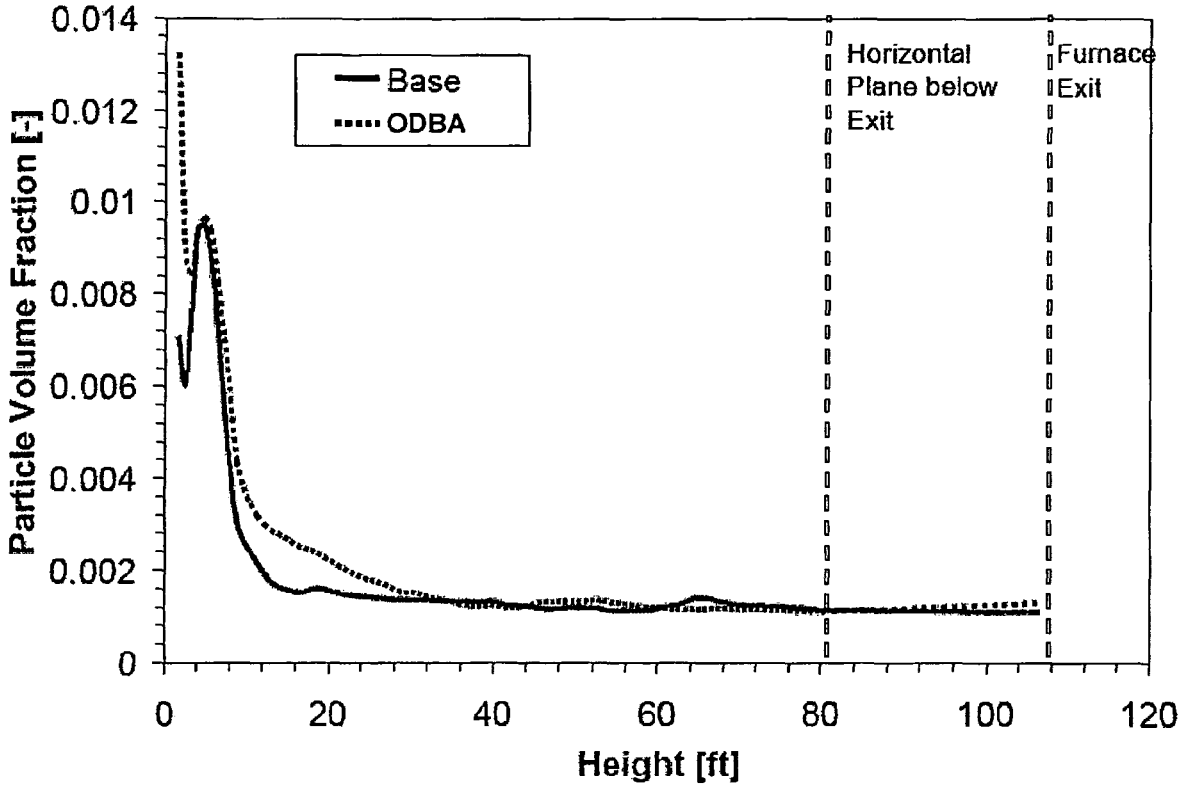
FIG. 4 is a graphical representation of the effect of Applicant's inventions on mass-averaged particle volume fraction relative to height.
Figure 5:
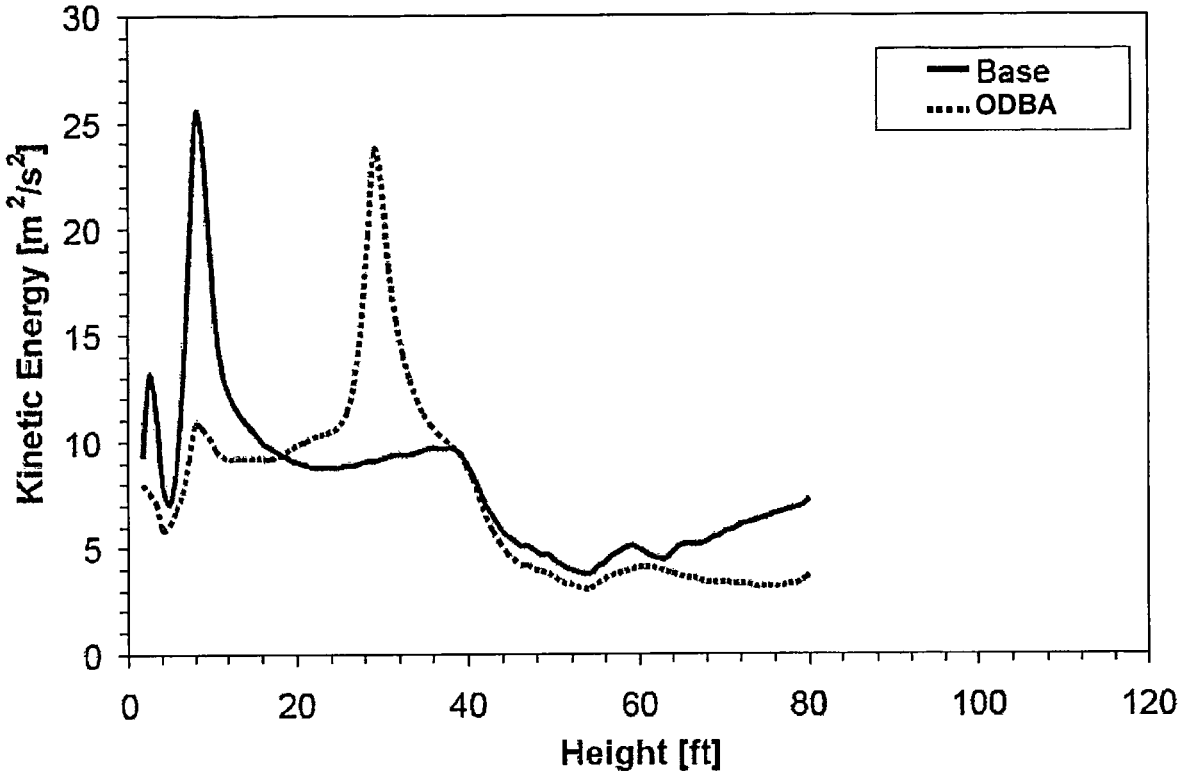
FIG. 5 is a graphical representation of the effect of Applicant's inventions on the mass weighted turbulent kinetic energy relative to height.
Figure 6:
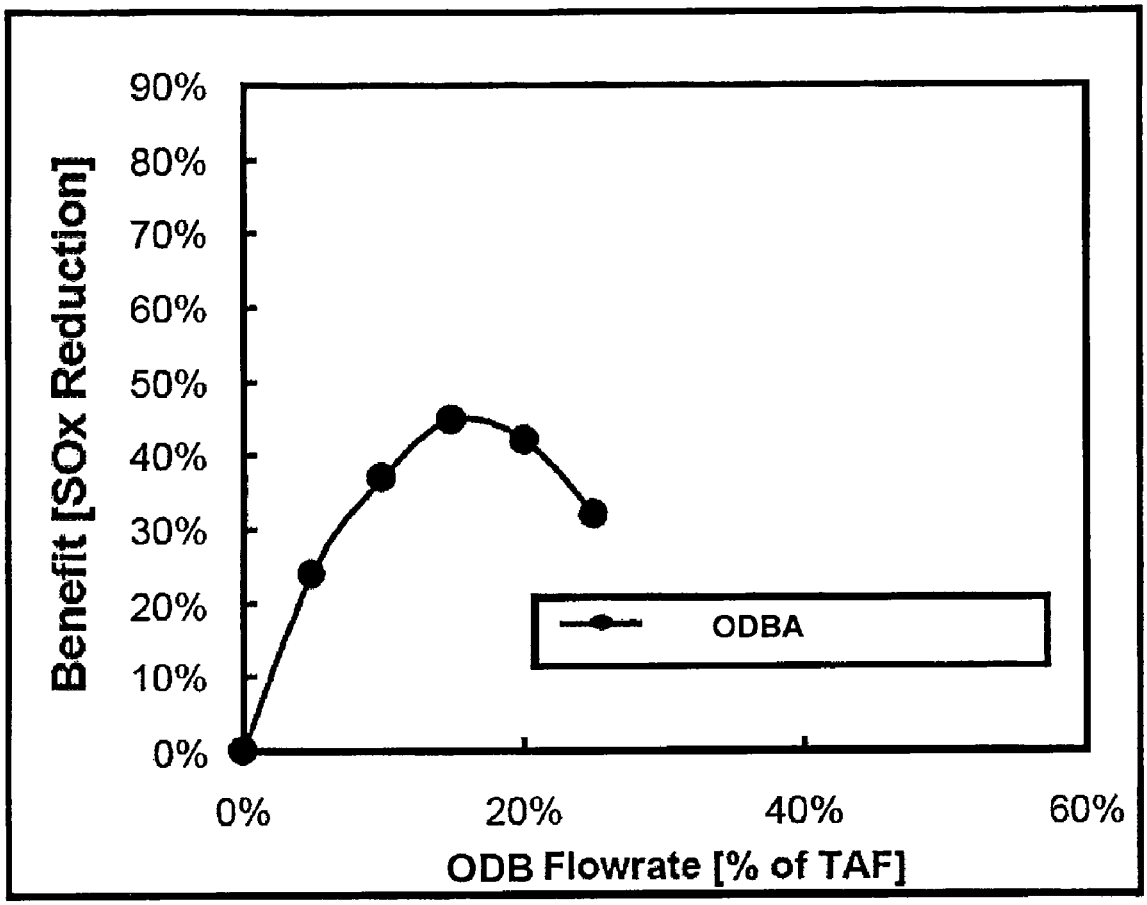
FIG. 6 is a graphical representation of a problem discovered by Applicant.
Figure 7:
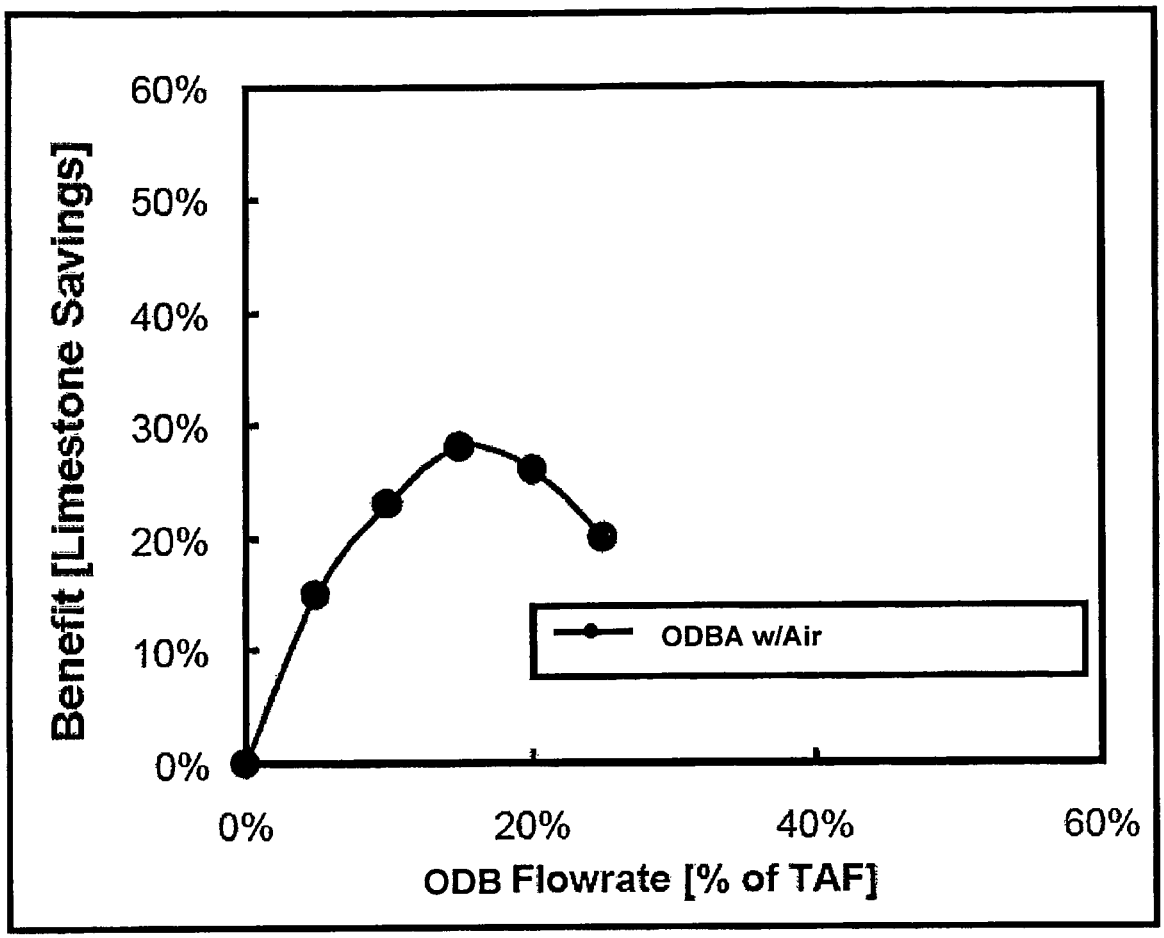
FIG. 7 is a graphical representation of another problem discovered by Applicant.
Figure 8:
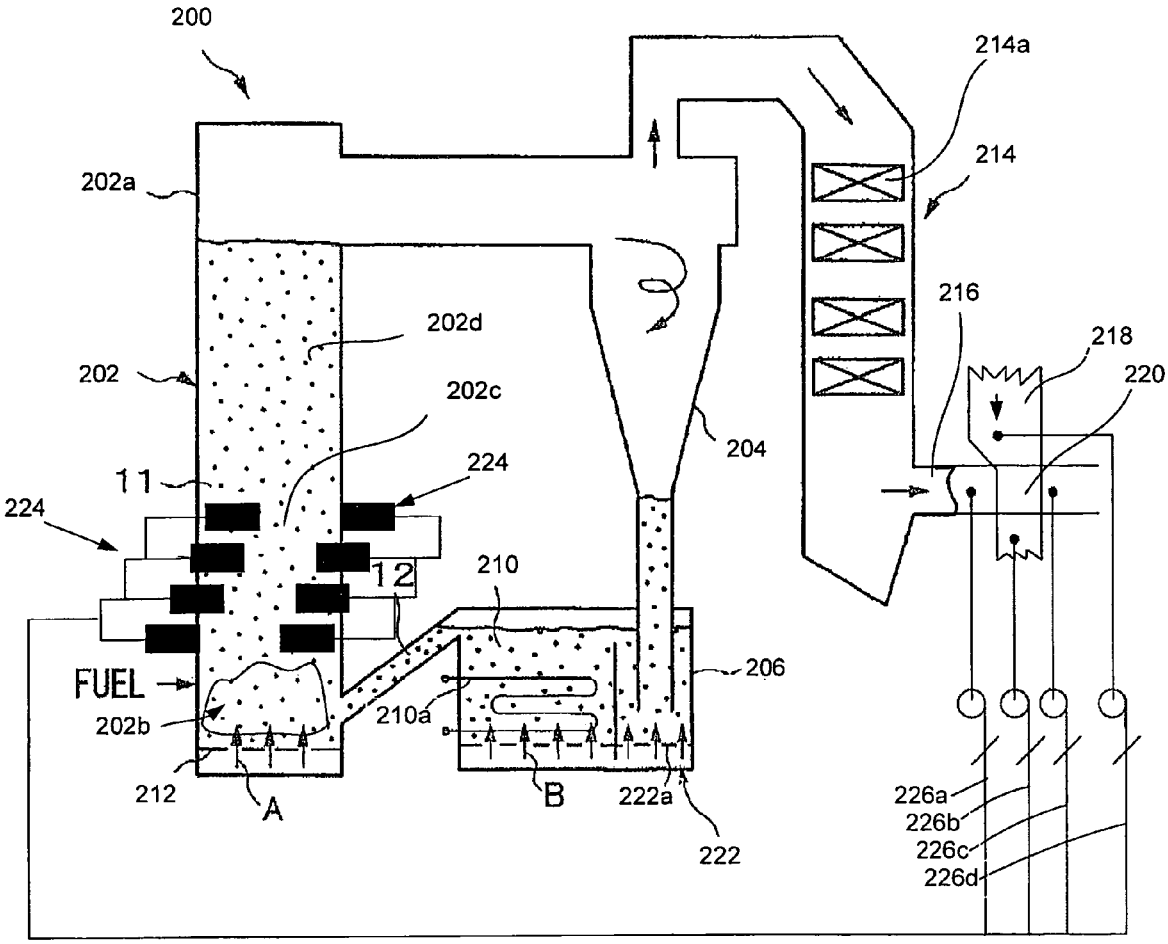
FIG. 8 is an illustration of a circulating fluidized bed boiler according to one embodiment of the present inventions.

FIG. 8 shows one embodiment of a circulating fluidized bed boiler, designated generally as 200, of the present invention. As depicted, boiler 200 includes furnace 202, cyclone dust collector 204, seal box 206, external heat exchanger 210, heat recovery area 214, flue gas duct 216, secondary air source 218, air heater 220, air box 222, and secondary air and recirculated flue gas injection devices 224.

In terms of general operation, fuel is combusted in furnace 202, which produces flue gas. Flue gas flows into cyclone dust collector 204. Cyclone dust collector 204 separates particles from the gas and stores particles in seal box 206. External heat exchanger 210 is positioned in fluid communication with seal box 206. Air box 222 sends fluidizing air B upwards, typically through air distribution plate 222*a*. The particles in seal box 206 are introduced to external heat exchanger 210 and in-bed tube 210*a* under fluidizing condition. External heat exchanger 210 may be used to perform heat exchange between the circulating particles and in-bed tubes. Flue gas also flows from furnace 202 to heat recovery area 214 and on to flue gas duct 216. Heat recovery area 214 may contain heat transfer surfaces 214*a*. A super heater and economizer may be contained in heat recovery area 214.

In this embodiment, air-pre heater, or heater, 220 is positioned along duct 216. Heater 220 is also positioned in fluid communication with secondary air source 218. As shown, a plurality of ducts 226*a-d* connect duct 216 and secondary air source 218 to injection devices 224. Other embodiments may include fewer ducts, e.g., ducts similar to 226*a* and 226*b*, 226*a* and 226*d*, 226*c* and 226*b*, 226*c* and 226*d*, etc. Still, other embodiments may include similar combinations of three ducts, or more.

Figure 11:
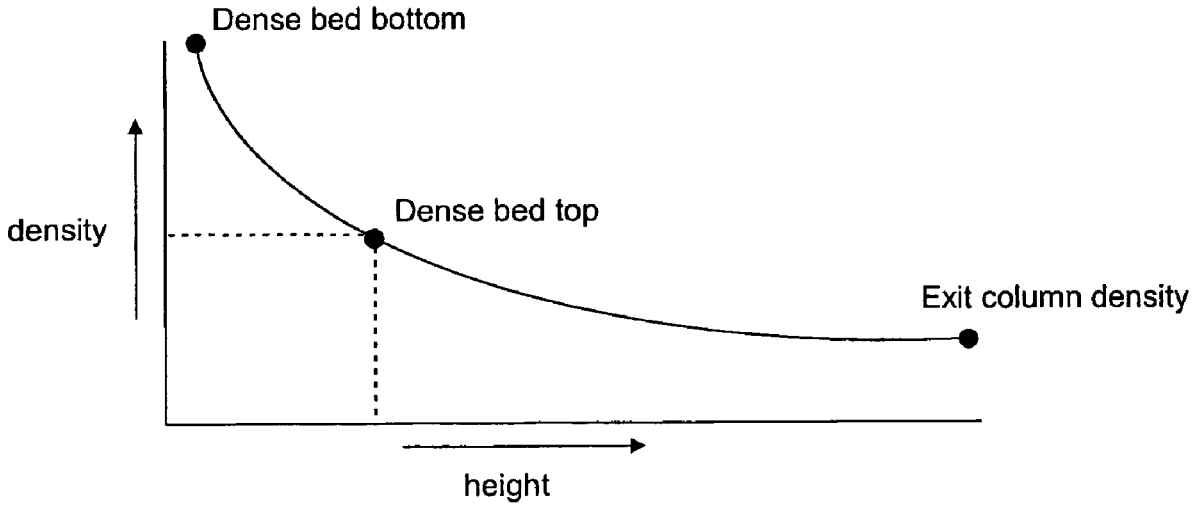
FIG. 11 is a graphical representation of the relationship of gas and particle density versus furnace height in the CFB.

Furnace 202 includes water cooled furnace wall 202*a*. Furnace 202 also includes a circulating fluidized bed, comprising dense bed portion 202*b* and lower furnace portion 202*c*. Lower furnace portion 202*c* is above dense bed 202*b*. An upper furnace portion 202*d* is located below the lower furnace portion. Located at the bottom of furnace 202 are air distribution nozzles 212. Air distribution nozzles 212 introduce fluidizing air A to furnace 202 to help create a fluidizing condition. Typically, dense bed portion 202*b* is a fuel rich stage, maintained below the stoichiometric ratio, and lower furnace portion 202*c* is a fuel lean stage, maintained above the stoichiometric ratio. In most embodiments, the dense bed will have a density greater than about twice the furnace exit density. Density can be conferred through column pressure measurement techniques well known in the art. As used, column density is synonymous with gas and/or particle density. FIG. 11 is a graphical representation of the relationship of gas and particle density versus furnace height in the CFB.

Secondary air and recirculated flue gas injection devices 224 are positioned downstream of dense bed 202*b*. In one embodiment, devices 224 are located in the lower furnace portion 202*c* of the circulating fluidized bed boiler. Injection devices will typically be positioned to create rotation. For example, devices 224 may be in an asymmetrical positioning with respect to one another. Since many boilers are wider than they are deep, in an embodiment, a user may set up two or more sets of injection devices to promote counter rotating. Further, injection devices may be opposed inline, opposed staggered, or opposed inline and opposed staggered. Still, some may desire non-opposed positioning, which is also within the scope of the present invention. Devices 224 are typically designed to give rotation to the flue gas, and thus further increase downstream mixing. In one embodiment, devices 224 include high-pressure air injection nozzles configured to introduce high velocity, high momentum, and high kinetic energy turbulent jet flow. Exit velocity may vary from embodiment to embodiment. In some embodiments, exit velocities may be in excess of about 50 m/s. In most embodiments, the exit velocities may be in excess of about 100 m/s.

The height, or vertical positioning, of the injection devices may also vary. For example, in different embodiments, injection devices may be positioned about 10 to about 30 feet above the dense bed. Injection device height may also be determined based on density within the furnace. For example, in some embodiments, injection devices will be positioned at a height in the furnace above the dense bed, wherein the ratio of the exit column density to the density of the dense bed top is greater than about 0.6. Still, in other embodiments, injection devices may be positioned at a height in the furnace wherein the gas and particle density is less than about 165% of the exit column density. Furnace exit column measurement may be made at the entrance to the cyclone dust collector.

Devices 224 may further be configured to have a variety of jet penetrations. In one embodiment, at least one of devices 224 is configured to have a jet penetration, when unopposed, of greater than about 50% of the furnace width. The jet stagnation of injection devices 224 may also vary. For example, in one embodiment jet stagnation pressure may range from about will be about 15 inches to about 70 inches of water above the furnace pressure, or higher. For example, often times, jet stagnation pressure may be about 30, about 35, about 40, about 45, about 50, about 55, about 60, about 65, or about 70 inches of water above the furnace pressure.

Devices 224 are further configured to deliver up to about 80% of the total air flow to the boiler, and more typically about 10% to about 80% of the total air flow to the boiler. As seen in FIG. 8, devices 224 are in fluid communication with secondary air source 218. Injection devices are also in fluid communication with duct 216, through which flue gas can be recirculated. Using this and similar configurations, air flow can be varied. For example, devices 224 can deliver an amount of secondary air and recirculated flue gas as a percentage of total air flow including greater than about 20%, greater than about 25%, greater than about 30%, greater than about 35%, greater than about 40%, greater than about 45%, greater than about 50%, greater than about 55%, greater than about 60%, greater than about 65%, greater than about 70%, greater than about 75%, and greater than about 80%. In other embodiments, secondary air and recirculated flue gas may be, as a percentage of total air flow, about 10% to about 80%, about 20% to about 80%, about 25% to about 80%, about 30% to about 80%, about 35% to about 80%, about 40% to about 80%, about 45% to about 80%, about 50% to about 80%, about 55% to about 80%, about 60% to about 80%, about 65% to about 80%, about 70% to about 80%, and about 75% to about 80%.

Typically, devices 224 will be configured to deliver secondary air, as a percentage of total air flow, in amounts including about 1% to about 40%, about 5% to about 40%, about 10% to about 40%, about 15% to about 40%, about 20% to about 40%, about 25% to about 40%, about 30% to about 40%, and about 35% to about 40%. In these embodiments, devices 224 may further be configured to deliver recirculated flue gas, as a percentage of total air flow, in amounts including about 1% to about 40%, about 5% to about 40%, about 10% to about 40%, about 15% to about 40%, about 20% to about 40%, about 25% to about 40%, about 30% to about 40%, and about 35% to about 40%. In most embodiments, devices 224 will deliver about 20% to about 40% secondary air as a percentage of total air flow and about 20% to about 40% recirculated flue gas as a percentage of total air flow.

Applicant believes that the present inventions provides a vigorous mixing of the fluidized bed space, resulting in greater reaction efficiency between the $SO_2$ and limestone and thereby permitting the use of less limestone to achieve a given $SO_2$ reduction level. The enhanced mixing allows the stoichiometric ratio of Ca/S to be reduced, while achieving the same level of $SO_2$ reduction. Similarly, the vigorous mixing produced by the present inventions may also prevents channels or plumes and consequential lower residence time of sulfur compounds, thereby allowing compounds more time to react in the reactor and further increasing the reaction efficiency. The vigorous mixing also provides for more homogeneous combustion of fuel, thereby reducing "hot spots" in the boiler that can create NOx.

In this embodiment, devices 224 are connected to a variety of ducts 226*a*, 226*b*, 226*c*, and 226*a*. Duct 226*a* connects to duct 216 upstream of air heater 220, and is thereby capable of providing cold recirculated flue gas to devices 224. Duct 226*c* connects to duct 216 downstream of air heater 220, and is thereby capable of providing hot recirculated flue gas to devices 224. Duct 226*c* connects to secondary air source 218 downstream of air heater 220, and is thereby capable of providing hot secondary air to devices 224. Duct 226*d* connects to secondary air source upstream of air heater 220, and is thereby capable of providing cold secondary air to ducts 224. Secondary air source typically includes ambient air. The use of ducts, e.g., 226*a*-226*d*, may provide alternative benefits as well. For example, by blending different amounts of hot and cold FGR and hot and cold SA, it may be possible to vary the bed temperature to improve SOx capture, as the reaction with limestone is often temperature dependent. Other embodiments may use, for example, ducts for only cold secondary air and cold flue gas. Still, another embodiment might use ducts for cold flue gas, cold secondary air, and hot secondary air. Any variety of combinations is possible for various embodiments.

Most embodiments of the invention will include injecting a combination of secondary air and recirculated flue gas above the dense bed. Other embodiments of the present invention, may inject only recirculated flue gas above the dense bed. These embodiments typically include the injection of sufficient secondary air into the dense bed to allow sufficient combustion to occur.

Temperatures of hot and cold recirculated flue gas and secondary air may vary from embodiment to embodiment. For example, hot recirculated flue gas may be from about 550° F. to about 750° F. Cold recirculated flue gas may be from about 200° F. to about 350° F. Hot secondary air may be from about 350° F. to about 700° F. Cold secondary air is typically ambient air temperature, and may be, for example, from about 0° F. to about 100° F.

Using systems and methods of the present invention, the problems mentioned above can be overcome. Applicant also believes that the present inventions achieve all the benefits and advances discussed above in the ODBA technology section, including the information contained in the graphs and tables related to ODBA. The additional efficacy and benefits of the present invention are discussed below.

Figure 9:
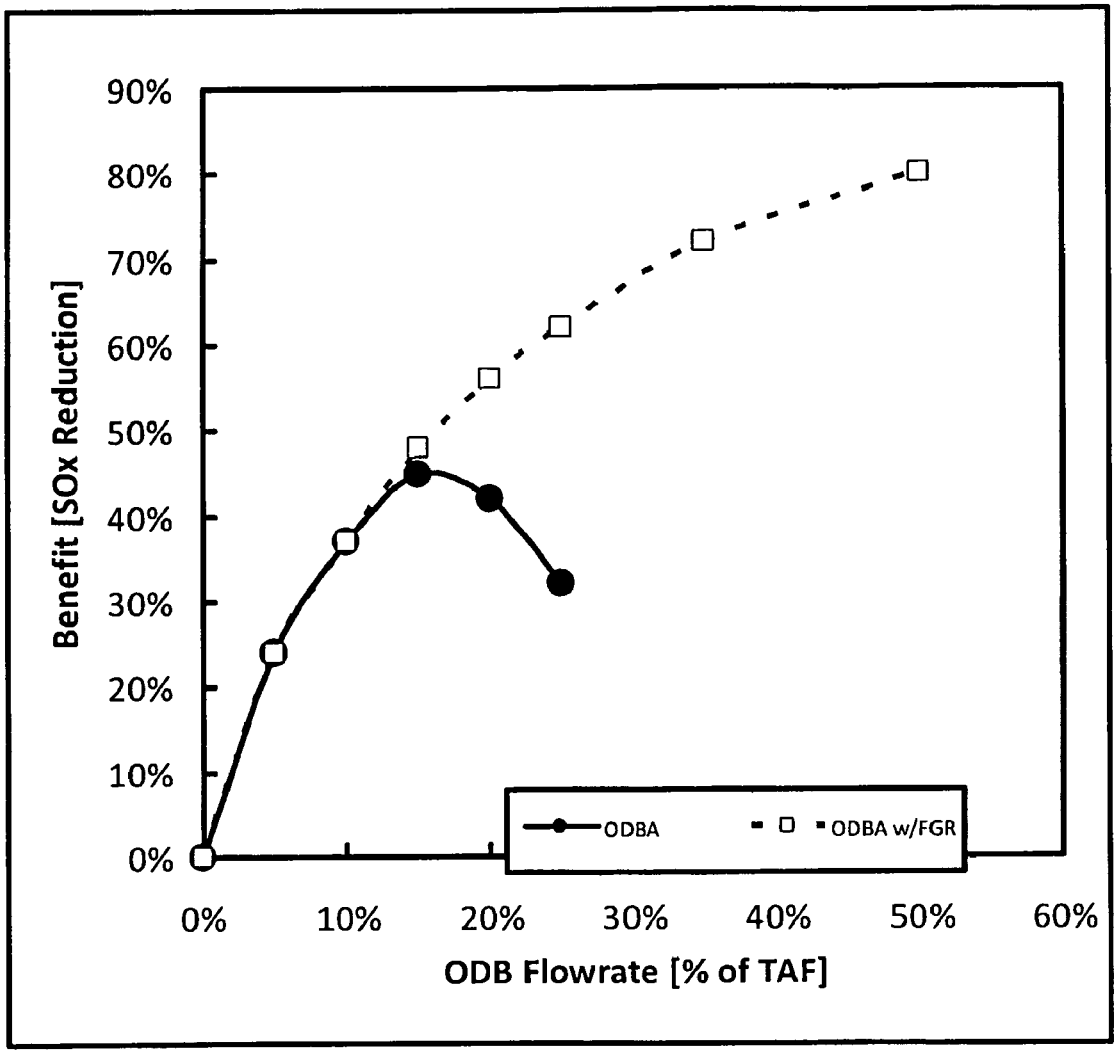
FIG. 9 is a graphical representation of the relationship between flowrate and SOx reduction according to one embodiment of the invention.

Table 4 summarizes, based on Applicant's experience, exemplary amounts of SOx reduction achievable by the present invention relative to ODBA technology alone. These results are graphically depicted in FIG. 9.

TABLE 4

| Mass flow through ODB (% of TAF) | SOx reduction ODBA | SOx reduction ODBA w/FGR |
|---|---|---|
| 0% | 0% | 0% |
| 5% | 24% | 24% |
| 10% | 37% | 37% |
| 15% | 45% | 48% |
| 20% | 42% | 56% |
| 25% | 32% | 62% |
| 35% | | 72% |
| 50% | | 80% |

Figure 10:
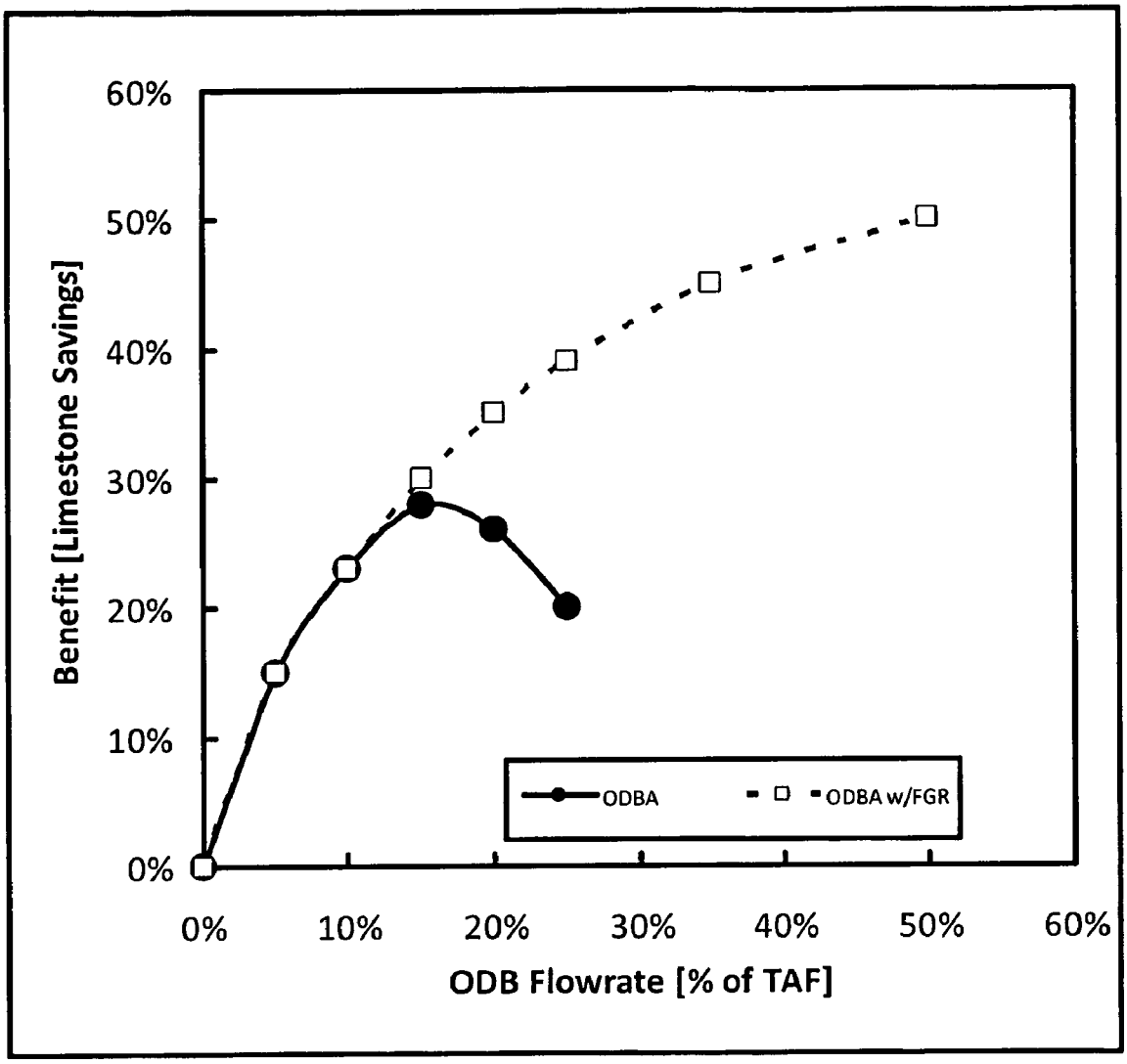
FIG. 10 is a graphical representation of the relationship between flowrate and reactant utilization.

Table 5 summarizes, based on Applicant's experience, the percentage of limestone savings achievable by the present invention relative to ODBA technology alone. These results are graphically depicted in FIG. 10.

TABLE 5

| Mass flow through ODB (% of TAF) | Limestone Savings ODBA | Limestone Savings ODBA w/FGR |
|---|---|---|
| 0% | 0% | 0% |
| 5% | 15% | 15% |
| 10% | 23% | 23% |
| 15% | 28% | 30% |
| 20% | 26% | 35% |
| 25% | 20% | 39% |
| 35% | | 45% |
| 50% | | 50% |

Based on the above tables and graphs, it can be seen that the present invention provides various unexpected improvements over the related technology. The present invention is based, in part, on the discovery that there are unexpected limits as to how much secondary air can be used in the upper furnace for mixing. Not to be limited to any particular mechanisms, Applicant believes that the use of recirculated flue gas (FGR) along with secondary air (SA), allows for increased mixing in the upper furnace without resulting in a lack of combustion air in the lower furnace.

The enhanced mixing achieved using the present invention is predicted to reduce the stoichiometric ratio of Ca/S in the CFB from ~3.0 to ~2.4, while achieving the same level of $SO_2$ reduction (92%). The reduction in Ca/S corresponds to reduced limestone required to operate the boiler and meet $SO_2$ regulations. Since limestone for CFB units often costs more than the fuel (coal or gob), this is a significant reduction on the operational budget for a CFB plant.

The mechanisms for reduction of $SO_2$ and other chemical species by limestone reaction through mixing have been discussed above. However, the calculated and observed results achieved were unexpected. Again, not to be limited to any particular mechanism, Applicant believes that the use of deep staging in the primary stage reduces the magnitude of the gas channels formed in the primary stage in, and the addition of injection devices above the dense bed reduces channel formation and causes the collapse of the channel below it.

Table 6 provides examples of various ODB air and gas source combinations that Applicant believes will be useful for practicing different embodiments of the present invention.

TABLE 6

| | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| SA (before heater) % of TAF | ≈5-15 | ≈15-30 | ≈0 | ≈0 | ≈30-40 | ≈0 | ≈5-10 | ≈5-10 | ≈1-5 | ≈10-20 |

TABLE 6-continued

| | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| SA (after heater) % of TAF | ≈5-15 | ≈0 | ≈15-30 | ≈15-30 | ≈0 | ≈30-40 | ≈5-10 | ≈5-10 | ≈10-20 | ≈1-5 |
| FGR (before heater) % of TAF | ≈5-15 | ≈15-30 | ≈0 | ≈15-30 | ≈5-10 | ≈5-10 | ≈30-40 | ≈0 | ≈1-5 | ≈10-20 |
| FGR (after heater) % of TAF | ≈5-15 | ≈0 | ≈15-30 | ≈0 | ≈5-10 | ≈5-10 | ≈0 | ≈30-40 | ≈10-20 | ≈1-5 |

Table 7 shows an example of operating conditions for a baseline system, a system operating with ODB air as 20% of total air flow, a system operating with ODB recirculated flue gas as 20% of total air flow, and a system operating with a combination of secondary air and recirculated flue gas as 20% of total air flow.

TABLE 7

| | Unit | Baseline | ODB Air (20%) | ODB FGR (20%) | ODB AIR & FGR (20%) |
|---|---|---|---|---|---|
| System load | MW gross | 122 | 122 | 122 | 122 |
| Net load | MW net | 109 | 109 | 109 | 109 |
| System firing rate | MMBtu/hr | 1226 | 1226 | 1226 | 1226 |
| Ssytem excess O2 | %-wet | 2.6 | 2.6 | 2.6 | 2.6 |
| System excess Air | % | 14.9 | 14.9 | 14.9 | 14.9 |
| System coal flow | kpph | 187 | 187 | 187 | 187 |
| Total air flow (TAF) | kpph | 1114 | 1114 | 1114 | 1114 |
| Primary air flow rate through bed grid | kpph | 476 | 476 | 476 | 476 |
| Primary air flow rate through 14 ports | kpph | 182 | 182 | 182 | 182 |
| Primary air temperature | Deg F. | 434 | 434 | 434 | 434 |
| Secondary air flow rate through 18 injection ports | kpph | 262 | 40 | 262 | 151 |
| Secondary air through 4 start-up burners | kpph | 104 | 104 | 104 | 104 |
| Secondary air through 4 coal feeders | kpph | 65 | 65 | 65 | 65 |
| Air flow rate through limestone injection | kpph | 11.5 | 11.5 | 11.5 | 11.5 |
| Air flow through loop seal | kpph | 12.8 | 12.8 | 12.8 | 12.8 |
| Secondary air temperature | Deg F. | 401 | 401 | 401 | 401 |
| Limestone injection rate | kpph | 40 | 40 | 40 | 40 |
| Solid recirculation rate | kpph | 8800 | 8800 | 8800 | 8800 |
| ODB Air flow | kpph | 0 | 222 | 0 | 111 |
| ODB FGR flow | kpph | 0 | 0 | 222 | 111 |

The present inventions also include methods of operating a furnace having a circulating fluidized bed, for example, similar to described above. In most embodiments, the methods comprise combusting fuel in the fluidized bed, which typically includes a dense bed portion and a lower furnace portion adjacent to the dense bed portion. Dense bed portions are most commonly maintained as fuel rich, while the lower furnace portion is most commonly maintained as a fuel lean stage. A reactant, e.g., limestone, is injected into the furnace to reduce the emission of at least one combustion product in the flue gas. In most embodiments, flue gas is injected above the dense bed. In many embodiments, secondary air is also injected above the dense bed.

Most typically, secondary air and recirculated flue gas are injected in the lower furnace portion of the circulating fluidized bed above the dense bed. The injection of the secondary air and the injection of the recirculated flue gas may be at various places in the lower furnace portion. Typically, the secondary air is injected at a height in the furnace where column density is less than about 165% of the furnace exit column density, and recirculated flue gas is injected at a height in the furnace where column density is less than about 165% of the furnace exit column density. This density region may vary from furnace to furnace or from fluidized bed to fluidized bed, and may be, in some instances, a position between about 10 feet and 30 feet above the dense bed portion. In other embodiments, secondary air may be injected at a height in the furnace above the dense bed, wherein the ratio of the exit column density to the column density of the dense bed top is greater than about 0.6. In other embodiments, recirculated flue gas may be injected at a height in the furnace above the dense bed, wherein the ratio of the exit column density to the column density of the dense bed top is greater than about 0.6. The column density of the dense bed portion may vary, but in most instances, it will be greater than about twice the furnace exit column density.

The injection of secondary air and recirculated flue gas may be performed through at least one injection device, but will typically be performed by a plurality of devices. In most embodiments, the plurality of injection devices are positioned to create rotation in the furnace. To, inter alia, enhance mixing, most embodiments will inject gas and air with a jet penetration, when unopposed, of greater than about 50% of the furnace width. In many embodiments, injection devices will inject gas or air with a jet stagnation pressure from about 15 inches to about 70 inches of water above the furnace pressure, or higher. For example, often times, jet stagnation pressure may be about 30, about 40, about 50, about 60, or about 70, etc. inches of water above the furnace pressure.

The amount of secondary air and recirculated flue gas injected, as a percentage of total air flow to the boiler, may vary from embodiment to embodiment. In most embodiments, gas and air may be injected at about 10% to about 80% of the total air flow to the boiler. In other embodiments, secondary air and recirculated flue gas may be injected, as a percentage of total air flow, at about 20% to about 80%, at about 25% to about 80%, at about 30% to about 80%, at about 35% to about 80%, at about 40% to about 80%, at about 45% to about 80%, at about 50% to about 80%, at about 55% to about 80%, at about 60% to about 80%, at about 65% to about 80%, about 70% to about 80%, or at about 75% to about 80%. Still, in these or other embodiments, the amount of secondary air and the amount of recirculated flue gas may also be varied. For example, in some embodiments secondary air may be injected in an amount, as a percentage of total air flow, of about 1% to about 40%, about 5% to about 40%, about 10% to about 40%, about 15% to about 40%, about 20% to about 40%, about 25% to about 40%, about 30% to about 40%, and about 35% to about 40%, and, recirculated flue gas may be injected in an amount, as a percentage of total air flow, of about 1% to about 40%, about 5% to about 40%, about 10% to about 40%, about 15% to about 40%, about 20% to about 40%, about 25% to about 40%, about 30% to about 40%, and about 35% to about 40%.

As noted, embodiments of the present invention also include injecting cold or hot secondary air and recirculated flue gas. In many embodiments, injection will include either cold or hot secondary air and either cold or hot recirculated flue gas. In other embodiments, injection may include other combinations. The various temperatures of cold and hot air and gas are similar to discussed above. Using these methods, and methods described above, the advances of the present invention can be achieved.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed. By way of example, secondary air and recirculated flue gas injection ports could be installed inline and only some of the secondary air and recirculated flue gas injection ports may operate at any given time. Alternatively, all of the secondary air and recirculated flue gas injection ports may be run, with only some of the air ports running at full capacity. It should be understood that all such modifications and improvements are properly within the scope of the following claims.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It should also be noted that features of various embodiments described above are not mutually exclusive, unless otherwise noted, and may be substituted from embodiment to embodiment to achieve the present inventions.

It is further noted that, as used in this specification, the singular forms "a," "an," and "the" include plural referents unless expressly and unequivocally limited to one referent.

What is claimed is:

1. A circulating fluidized bed boiler having improved reactant utilization, the boiler comprising:

a circulating fluidized bed including a dense bed portion, and a lower furnace portion above the dense bed portion;

a reactant to reduce the emission of at least one combustion product in the flue gas; and a plurality of recirculated flue gas and secondary air injection devices positioned asymmetrically with respect to one another above the dense bed, wherein the devices are configured to mix the reactant and the flue gas in the furnace above the dense bed, thereby reducing the amount of reactant needed to reduce the emission of the at least one combustion product.

2. The apparatus according to claim 1, further including a return system for returning carry over particles from the flue gas to the circulating fluidized bed.

3. The apparatus according to claim 2, wherein the return system includes a separator for removing the carry over particles from the flue gas.

4. The apparatus according to claim 3, wherein the separator is a cyclone separator.

5. The apparatus according to claim 3, further including a fines collector downstream from the separator.

6. The apparatus according to claim 5, wherein the fines collector is a bag house.

7. The apparatus according to claim 5, wherein the fines collector is an electrostatic precipitator.

8. The apparatus according to claim 1, wherein the reactant is selected from the group consisting of caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ({Ni, Mg, Fe}$CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), and mixtures thereof.

9. The apparatus according to claim 1, wherein the reactant is limestone.

10. The apparatus according to claim 1, wherein the dense bed portion of the circulating fluidized bed boiler is a fuel rich stage.

11. The apparatus according to claim 10, wherein the dense bed portion of the circulating fluidized bed is maintained below the stoichiometric ratio.

12. The apparatus according to claim 1, wherein the lower furnace portion is a fuel lean stage.

13. The apparatus according to claim 12, wherein the lower furnace portion is maintained above the stoichiometric ratio.

14. The apparatus according to claim 1, wherein the secondary air and recirculated flue gas injection devices are located in the lower furnace portion of the circulating fluidized bed boiler.

15. The apparatus according to claim 1, wherein the secondary air and recirculated flue gas injection devices are arranged in a way selected from the group consisting of opposed inline, opposed staggered, and combinations thereof.

16. The apparatus according to claim 1, wherein the secondary air and recirculated flue gas injection devices are positioned between about 10 feet and 30 feet above the dense bed.

17. The apparatus according to claim 1, wherein the ratio of the exit column density to the column density of the dense bed top is greater than about 0.6, and wherein the secondary air and recirculated flue gas injection devices are positioned at a height in the furnace above the top of the dense bed.

18. The apparatus according to claim 1, wherein an unopposed jet penetration of each secondary air and recirculated flue gas injection device is greater than about 50% of the furnace width.

19. The apparatus according to claim 1, wherein the jet stagnation pressure is greater than about 15 inches of water above the furnace pressure.

20. The apparatus according to claim 19, wherein the jet stagnation pressure is about 15 inches to about 70 inches of water above the furnace pressure.

21. The apparatus according to claim 1, wherein the secondary air and recirculated flue gas injection devices are positioned at a height in the furnace wherein the column density is less than about 165% of the exit gas column density.

22. The apparatus according to claim 1, wherein the secondary air and recirculated flue gas injection devices deliver about 10% to about 80% of the total air flow to the boiler.

23. The apparatus according to claim 1, wherein the secondary air and recirculated flue gas injection devices deliver about 20% to about 70% of the total air flow to the boiler.

24. The apparatus according to claim 1, wherein the secondary air and recirculated flue gas injection devices deliver an amount of air as a percentage of total air flow to the boiler selected from the group consisting of greater than about 20%, greater than about 25%, greater than about 30%, greater than about 35%, greater than about 40%, greater than about 45%, greater than about 50%, greater than about 55%, greater than about 60%, greater than about 65%, greater than about 70%, greater than about 75%, and greater than about 80%.

25. The apparatus according to claim 1, wherein the secondary air and recirculated flue gas injection devices deliver an amount of air as a percentage of total air and flow to the boiler selected from the group consisting of: about 10% to about 80%, about 20% to about 80%, about 25% to about 80%, about 30% to about 80%, about 35% to about 80%, about 40% to about 80%, about 45% to about 80%, about 50% to about 80%, about 55% to about 80%, about 60% to about 80%, about 65% to about 80%, about 70% to about 80%, and about 75% to about 80%.

26. The apparatus according to claim 1, wherein the secondary air and recirculated flue gas injection devices deliver an amount of secondary air as a percentage of total air flow selected from the group consisting of about 1% to about 40%, about 5% to about 40%, about 10% to about 40%, about 15% to about 40%, about 20% to about 40%, about 25% to about 40%, about 30% to about 40%, and about 35% to about 40%; and wherein the secondary air and recirculated flue gas injection devices deliver an amount of recirculated flue gas as a percentage of total air flow selected from the group consisting of about 1% to about 40%, about 5% to about 40%, about 10% to about 40%, about 15% to about 40%, about 20% to about 40%, about 25% to about 40%, about 30% to about 40%, and about 35% to about 40%.

27. The apparatus according to claim 1, wherein the secondary air and recirculated flue gas injection devices deliver about 20% to about 40% secondary air as a percentage of total air flow and about 20% to about 40% recirculated flue gas as a percentage of total air flow.

28. The apparatus according to claim 1, wherein the plurality of secondary air and recirculated flue gas injection devices includes at least four injection devices positioned downstream of the dense bed for providing mixing of the reactant and the flue gas in the furnace above the dense bed.

29. The apparatus according to claim 1, wherein at least one of the plurality of secondary air and recirculated flue gas injection devices is configured to provide cold FGR.

30. The apparatus according to claim 29, wherein the cold FGR has a temperature of about 200° F. to about 350° F.

31. The apparatus according to claim 1, wherein at least one of the plurality of secondary air and recirculated flue gas injection devices is configured to provide hot FGR.

32. The apparatus according to claim 31, wherein the hot FGR has a temperature of about 550° F. to about 750° F.

33. The apparatus according to claim 1, wherein at least one of the plurality of secondary air and recirculated flue gas injection devices is configured to provide cold SA.

34. The apparatus according to claim 33, wherein the cold SA has a temperature of about 0° F. to about 100° F.

35. The apparatus according to claim 1, wherein at least one of the plurality of secondary air and recirculated flue gas injection devices is configured to provide hot SA.

36. The apparatus according to claim 35, wherein the hot SA has a temperature of about 350° F. to about 700° F.

37. The apparatus according to claim 1, wherein the plurality of secondary air and recirculated flue gas injection devices is configured to provide at least cold or hot recirculated flue gas, and at least cold or hot secondary air.

38. A circulating fluidized bed boiler having improved reactant utilization, the boiler comprising:

a circulating fluidized bed including a dense bed portion, and a lower furnace portion above the dense bed portion;

a reactant to reduce the emission of at least one combustion product in the flue gas; and at least one secondary air and recirculated flue gas injection device above the dense bed for providing mixing of the reactant and the flue gas in the furnace above the dense bed, wherein the at least one device is configured to provide at least one of cold recirculated flue gas and hot secondary air, wherein the at least one device is positioned at a height in the furnace wherein the column density is less than about 165% of the exit column density, and wherein the at least one device is configured to deliver about 10% to about 80% of the total air flow to the boiler.

39. The apparatus according to claim 38, wherein the at least one device is configured to have an unopposed jet penetration of greater than about 50% of the furnace width.

40. The apparatus according to claim 38, wherein the at least one device is configured to have a jet stagnation pressure greater than about 15 inches of water above the furnace pressure.

41. The apparatus according to claim 40, wherein the jet stagnation pressure is between about 15 inches and 70 inches of water above the furnace pressure.

42. The apparatus according to claim 38, wherein the at least one device delivers an amount of air as a percentage of total air flow to the boiler selected from the group consisting of: about 10% to about 80%, about 20% to about 80%, about 25% to about 80%, about 30% to about 80%, about35% to about 80%, about 40% to about 80%, about 45% to about 80%, about 50% to about 80%, about 55% to about 80%, about 60% to about 80%, about 65% to about 80%, about 70% to about 80%, and about 75% to about 80%.

43. The apparatus according to claim 38, wherein the at least one device delivers an amount of secondary air as a percentage of total air flow selected from the group consisting of: about 1% to about 40%, about 5% to about 40%, about 10% to about 40%, about 15% to about 40%, about 20% to about 40%, about 25% to about 40%, about 30% to about 40%, and about 35% to about 40%; and wherein the at least one device delivers an amount of recirculated flue gas as a percentage of total air flow selected from the group consisting of: about 1% to about 40%, about 5% to about 40%, about 10% to about 40%, about 15% to about 40%, about 20% to about 40%, about 25% to about 40%, about 30% to about 40%, and about 35% to about 40%.

44. The apparatus according to claim 38, wherein the at least one device delivers about 20% to about 40% secondary air as a percentage of total air flow and about 20% to about 40% recirculated flue gas as a percentage of total air flow.

45. The apparatus according to claim 38, wherein the at least two of the devices are positioned downstream of the dense bed for providing mixing of the reactant and the flue gas in the furnace above the dense bed.

46. The apparatus according to claim 38, wherein the at least one device is configured to provide hot recirculated flue gas.

47. The apparatus according to claim 46, wherein the hot recirculated flue gas has a temperature of about 550° F. to about 750° F.

48. The apparatus according to claim 38, wherein the at least one device is configured to provide cold secondary air.

49. The apparatus according to claim 48, wherein the cold secondary air has a temperature of about 0° F. to about 100° F.

50. The apparatus according to claim 38, wherein the at least one device is configured to allow for the selective fluid delivery of at least two of cold recirculated flue gas, hot recirculated flue gas, cold secondary air, and hot secondary air.

51. The apparatus according to claim 38, wherein the cold recirculated flue gas has a temperature of about 200° F. to about 350° F.

52. The apparatus according to claim 38, wherein the hot secondary air has a temperature of about 350° F. to about 700° F.

53. A method of operating a furnace having a circulating fluidized bed, the method comprising:

combusting fuel in the fluidized bed, wherein the fluidized bed includes a dense bed portion and a lower furnace portion adjacent to the dense bed portion;

injecting a reactant into the furnace to reduce the emission of at least one combustion product in the flue gas;

injecting secondary air into the furnace; and injecting recirculated flue gas into the furnace above the dense bed, wherein the secondary air and recirculated flue gas are injected through a plurality of injection devices positioned to create rotation in the furnace, thereby reducing the amount of reactant needed to reduce the emission of said at least one combustion product.

54. The method of claim 53, wherein the secondary air is injected at a height in the furnace where column density is less than about 165% of the furnace exit column density.

55. The method of claim 53, wherein the recirculated flue gas is injected at a height in the furnace where column density is less than about 165% of the furnace exit column density.

56. The method of claim 53, wherein the secondary air is injected at a position between about 10 feet and 30 feet above the dense bed portion.

57. The method of claim 53, wherein the recirculated flue gas is injected at a position between about 10 feet and 30 feet above the dense bed portion.

58. The method of claim 53, wherein the ratio of the exit column density to the column density of the dense bed top is greater than about 0.6, and the secondary air is injected above the dense bed top.

59. The method of claim 53, wherein the ratio of the exit column density to the column density of the dense bed top is greater than about 0.6, and the recirculated flue gas is injected above the dense bed top.

60. The method of claim 53, wherein the dense bed portion has a column density greater than about twice the furnace exit column density.

61. The method of claim 53, wherein at least one of the plurality of injection devices is operated to have an unopposed jet penetration of greater than about 50% of the furnace width.

62. The method of claim 53, wherein at least one of the plurality of injection devices is operated with a jet stagnation pressure of greater than about 15 inches of water above the furnace pressure.

63. The method of claim 53, wherein at least one of the plurality of injection devices is operated with a jet stagnation pressure about 15 inches to about 70 inches of water above the furnace pressure.

64. The method of claim 53, wherein the secondary air and the recirculated flue gas provide about 10% to about 80% of the total air flow to the boiler.

65. The method of claim 53, wherein the secondary air and recirculated flue gas are injected, as a percentage of total air flow, in an amount selected from the group consisting of: about 10% to about 80%, about 20% to about 80%, about 25% to about 80%, about 30% to about 80%, about 35% to about 80%, about 40% to about 80%, about 45% to about 80%, about 50% to about 80%, about 55% to about 80%, about 60% to about 80%, about 65% to about 80%, about 70% to about 80%, and about 75% to about 80%.

66. The method of claim 53, wherein the secondary air is injected in an amount, as a percentage of total air flow, selected from the group consisting of: about 1% to about 40%, about 5% to about 40%, about 10% to about 40%, about 15% to about 40%, about 20% to about 40%, about 25% to about 40%, about 30% to about 40%, and about 35% to about 40%; and wherein the recirculated flue gas is injected in an amount, as a percentage of total air flow, selected from the group consisting of: about 1% to about 40%, about 5% to about 40%, about 10% to about 40%, about 15% to about 40%, about 20% to about 40%, about 25% to about 40%, about 30% to about 40%, and about 35% to about 40%.

67. The method of claim 53, wherein the secondary air is injected at about 20% to about 40% of total air flow, and the recirculated flue gas is injected at about 20% to about 40% of total air flow.

68. The method of claim 53, wherein the secondary air includes cold secondary air having a temperature of about 0° F. to about 100° F.

69. The method of claim 53, wherein the secondary air includes hot secondary air having a temperature of about 350° F. to about 700° F.

70. The method of claim 53, wherein the recirculated flue gas includes cold recirculated flue gas having a temperature of about 200° F. to about 350° F.

71. The method of claim 53, wherein the recirculated flue gas includes hot recirculated flue gas having a temperature of about 550° F. to about 750° F.

72. The method of claim 53, wherein the dense bed portion is operated as a fuel rich stage maintained below the stoichiometric ratio.

73. The method of claim 53, wherein the lower furnace portion is operated as a fuel lean stage maintained above the stoichiometric ratio.

74. The method of claim 53, wherein said reactant is selected from the group consisting of caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ($\{Ni, Mg, Fe\}CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), and mixtures thereof.

75. A circulating fluidized bed boiler having improved reactant utilization, the boiler comprising:

a circulating fluidized bed including a dense bed portion, and a lower furnace portion above the dense bed portion;

a reactant to reduce the emission of at least one combustion product in the flue gas; and a plurality of recirculated flue gas and secondary air injection devices above the dense bed, wherein at least one of the plurality of secondary air and recirculated flue gas injection devices is configured to provide at least one of cold FGR and hot SA, and wherein the devices are configured to mix the reactant and the flue gas in the furnace above the dense bed, thereby reducing the amount of reactant needed to reduce the emission of the at least one combustion product.

* * * * *